US007107631B2

(12) United States Patent
Lang et al.

(10) Patent No.: US 7,107,631 B2
(45) Date of Patent: Sep. 19, 2006

(54) DEVICE FOR CONTROLLING AND/OR REGULATING THE SUPPLY OF A MEDIUM, DEVICES OF THIS TYPE COMPRISING WASHING OR DRYING UNITS AND A CORRESPONDING METHOD

(76) Inventors: Edo Lang, Churweg 5, CH-7203 Trimmis (CH); Roland Obrist, Chalamandrin, CH-7412 Scharans (CH)

( * ) Notice: Subject to any disclaimer, the term of this patent is extended or adjusted under 35 U.S.C. 154(b) by 0 days.

(21) Appl. No.: 10/381,632

(22) PCT Filed: Sep. 20, 2001

(86) PCT No.: PCT/CH01/00571

§ 371 (c)(1),
(2), (4) Date: Sep. 22, 2003

(87) PCT Pub. No.: WO02/29168

PCT Pub. Date: Apr. 11, 2002

(65) Prior Publication Data

US 2004/0025248 A1 Feb. 12, 2004

(30) Foreign Application Priority Data

Oct. 3, 2000 (CH) ..... 1940/00

(51) Int. Cl.
*E03C 1/05* (2006.01)

(52) U.S. Cl. ..... 4/623; 251/129.04

(58) Field of Classification Search ..... 4/623; 251/129.04

See application file for complete search history.

(56) References Cited

U.S. PATENT DOCUMENTS 3,505,692 A * 4/1970 Forbes ..... 4/623
5,170,944 A 12/1992 Shirai

* cited by examiner

*Primary Examiner*—Charles E. Phillips
(74) *Attorney, Agent, or Firm*—Notaro & Michalos PC

(57) ABSTRACT

The invention relates to a device (2) for controlling and/or regulating the supply of a medium using a supply unit for an impingement device. Said supply unit comprises at least one shut-off member and each shut-off member can be moved into a closed position and at least one open position by means of an actuating element. The device comprises a sensor unit (50) for determining in a contactless manner the presence of a material that is to be impinged by the medium. The inventive device (2) is characterized in that said sensor unit (50) is additionally configured for the contactless determination of the relative position of the material in relation to the impingement device (10) and for the output of signals, which act on the actuating elements in such a way that the later moves the shut-oft members into a position that corresponds with the presence and the location of the material to be impinged by the medium. The washing and/or drying devices (10) preferably comprise a device (2) of this type for controlling and/or regulating the supply of water and/or warm air for washing and/or drying purposes. The invention also relates to a corresponding method.

14 Claims, 5 Drawing Sheets

DEVICE FOR CONTROLLING AND/OR REGULATING THE SUPPLY OF A MEDIUM, DEVICES OF THIS TYPE COMPRISING WASHING OR DRYING UNITS AND A CORRESPONDING METHOD

BACKGROUND OF THE INVENTION

The present invention relates to a washing and/or drying device according to the preamble of Claim 1.

In the framework of the present description, a washing and/or drying device is to be understood as a device like a washstand or sink unit, a bidet, toilet, urinal, a bathtub, a shower stall and/or a drying device for contactless hand drying. Washstands and sink units and drying devices of this type are used in plumbing units of all types, for body care in bathrooms, for example, for washing purposes in kitchens, for cleaning purposes in semi-public and public sanitary facilities such as toilets and shower rooms, as well as in laboratories, the food industry, homes for the elderly and convalescent, and hospitals. Depending on the use, porcelain, stoneware, stone, particularly natural stone such as marble, plastic, enameled sheet metal and chromed sheet steel are typical as materials for basins for installing or mounting washing devices of this type; modern basins are occasionally made of opaque plastics such as Corian and of transparent or translucent materials such as acrylic, glass, or Quaryl. Metals, such as lacquered and/or enameled sheet metal or even bare chromed sheet steel, are known above all as materials for housings of drying devices of the type cited.

It is to be noted here that the concept of fresh water in the framework of the present description is to be understood as cold and/or hot water flowing into the basin and the concept of dirty water is to be understood as water flowing out of the basin, including the additives contained therein.

The washing devices typically comprise a basin and a supply armature and typically also have a drain armature. The basin is delimited by a basin wall and is attachable to a structure or a building wall. The supply armature, which is generally referred to as a faucet, has a connecting piece, via which the fresh water reaches the basin. The connecting piece is connected to a building supply line for the fresh water; the fresh water is supplied to the basin from a tank or a network. Furthermore, the supply armature contains a shut-off member, which is movable and/or rotatable or displaceable between a closed setting and at least one open setting using an actuating element such as a control knob or lever. In the closed setting, the supply of fresh water to the basin is suppressed, in the open setting(s), the fresh water may reach the basin through the connecting piece at a greater or lesser flow rate. The supply armature is preferably attached in a first opening of the basin wall. The dirty water is preferably drained via a second opening, in which at least one drain armature is mounted, into a drain line. The drain armature typically includes a stench trap, which is usually referred to as a siphon.

The typical washing devices described above are subject to numerous disadvantages, which are more or less significant depending on their intended purpose. In particular, it is disadvantageous for various reasons, such as the danger of damage due to vandalism, and the comfort of use and cleaning, that the armatures, which are mounted on the edge region of the cavity of the basin, project into the inside of the basin.

Practical vandal-safe washing devices are known, which are used above all in washrooms of industrial operations. They have round basins, accessible from all sides, made of chromed sheet steel, which contain a column in their center, clad with chromed sheet steel and projecting well over the edge of the basin, in which the supply line of the fresh water is positioned. The column has openings in its upper region through which the fresh water flows out. However, this washing device is only suitable for cases in which a certain number of persons always use it simultaneously, since individual control of the water supply is not provided.

A practical vandal-safe drinking water dispenser, actually a fountain, in which a connecting piece for supplying the drinking water is integrated into the lowest point of the basin wall, is also known. Drinking water flows through the connecting piece in small quantities, i.e., upward in a thin stream, in such a way that the stream extends somewhat above the upper edge of the basin. The actual basin, which is concave upward, is largely covered by a hood outside the stream region, in order to prevent improper usage of the drinking water dispenser. The drinking water is supplied continuously, neither the quantity of drinking water over time nor its temperature may be controlled by the user of the drinking fountain.

A washing device according to the species, which functions automatically without the user having to touch any part of the device, is known from WO 93/10311. In this case, two sensors determine the presence of the hands to be washed and initiate a cleaning process controlled via a time relay. However, the user may not change the time sequence of the admission of wetting water, cleaner, and washing water, nor is he able to adjust the water requirements to his needs.

Therefore, it has been determined that no washing devices, particularly in the form of washstands and sink units, are known which ensure both sufficient security from vandalism and which also are optimally designed in regard to production, cleaning possibilities, and economic water consumption, but particularly also in regard to hygiene and comfort in use. A corresponding determination may also be made in regard to drying devices.

SUMMARY OF THE INVENTION

The object of the present invention is therefore to provide a washing and/or drying device of the type initially cited which avoids the disadvantages of the related art.

This object is achieved—according to a first aspect—by the features of Claim 1, in that a device for controlling and/or regulating a supply of a medium through a supply unit for an impingement device is suggested. In this case, the supply unit includes at least one shut-off member and each shut-off member may be brought into a closed position and/or at least one open position using an actuating element. In addition, the device includes a sensor device for contactless determination of the presence of material to be impinged by this medium. The device according to the present invention is distinguished in that this sensor device is additionally implemented for contactless determination of the relative position of this material in relation to the impingement device and for outputting signals which act on the actuating elements in such a way that these elements bring the shut-off members into a setting corresponding to the presence and the position of the material to be impinged using this medium. Refinements of the device for control and/or regulation according to the present invention result from the dependent claims.

The object is achieved according to a second aspect through the suggestion of a washing device and/or drying device, which are distinguished in that they include such a device for controlling the supply of water and/or hot air, for hand washing and/or hand drying. Preferred additional features and/or refinements of the washing and/or drying device according to the present invention result from the dependent claims.

This object is achieved according to a third aspect through the suggestion of a method for contactless control and/or regulation of a supply of a medium through a supply unit for an impingement device. In this case, the supply unit includes at least one shut-off member and each shut-off member may be brought into a closed position and/or at least one position using an actuating element. In addition, the device includes a sensor for contactless determination of the presences of material to be impinged using this medium, using which at least one (high-energy) field is generated. The method according to the present invention is distinguished in that the contactless detection of this at least one field using the sensor device registers the relative position of this material in relation to the impingement device and outputs signals which act on the actuating elements in such a way that these elements bring the shut-off members into a setting corresponding to the presence and the position of the material to be impinged using this medium. Refinements of the method according to the present invention result from the dependent claims.

A washing and/or drying device according to the present invention therefore differs from typical devices in that it has a supply device whose actuation may be remote-controlled as a function of the presence and position of the body parts (e.g., hands) to be washed and/or dried.

Advantages in relation to the related art result, for example, in that the washing devices suggested:

- are producible cost-effectively, since the expenses for the supply device, which is redimensioned in a certain way, are significantly lower;
- are more pleasant, easier, and more cost-effective to clean and the cleaning has more hygienic and visually better results—not only is the cleaning of a supply armature dispensed with, but rather there are also practically no transition regions between the basin and the supply device, which are well known to be difficult to clean—the object to be cleaned is completely visible;
- provide a higher comfort of use, since the access to the basin is not blocked or is blocked hardly at all by a supply armature and particularly because all functions of the supply armature may be controlled by the user without contact. This is advantageous from a hygienic viewpoint;
- are more aesthetic, because there are no large visible components of the supply device;
- are water-saving, because excess and useless water consumption is suppressed by the sensor controller for the supply of the fresh water, which is advantageous for reasons of hygiene, operating comfort, and for ecological and economic reasons.

The connecting piece of the supply device may be formed by the material of the basin wall, the delimitation of the opening simultaneously forming the wall of the connecting piece. For basins having basin walls of lesser wall thicknesses made of sheet metal, a deep-drawn connecting piece may be shaped on, preferably onto the outside of the basin. The connecting piece may also be formed by a pipe-like inserted part received in the opening and/or breakout. It may be attached there through suitable means; screws, press fitting, gluing, or possibly soldering may be considered for this purpose. The outlet region of the connecting piece is preferably implemented so that a bubbling fresh water stream which is mixed with air is generated, since in this way less water spray arises during use of the washing device.

For uses in regions which are especially subject to vandals, it is advisable to implement the washing device suggested in such a way that the outlet cross-section of the connecting piece is practically not visible and is not accessible for a user of the washing device. For this purpose, the connecting piece of the supply device is preferably integrated into the basin wall in such a way that its outlet cross-section lies essentially flush with the adjoining inner surface of the basin wall. In this case, the connecting piece is mounted fixed in a first opening. Such a washing device is vandal-safe, since there are no armature parts of the supply device to which the user has access. In this way, significant savings for repairs which arise with typical washing devices may be achieved. Coverage is possible through a rosette, as for a cylinder of a lock. Even if an outlet end of the connecting piece, which is provided with a fixed spray nozzle, projects slightly into the basin, vandalism may be avoided if a rosette similar to a truncated cone, which encloses the outlet end, is mounted, similar to the way in which they are frequently used for protecting cylinders of locks.

However, the washing device suggested is also suitable for regions in which no vandalism is to be feared. In such regions, it is not imperative for the supporting piece to be integrated into the basin wall and mounted fixed therein in such a way that its outlet cross-section is positioned practically flush with the inner surface of the basin wall. It may even be desirable for the connecting piece to have a connecting piece extension, protecting slightly into the inside of the basin, which runs at least approximately in the direction of the opening. The connecting piece extension is dimensioned in this case in such a way that the outlet cross-section of the connecting piece is near the basin wall, so that the access to the basin is kept free. This implementation of the connecting piece would also allow operating units to be attached to the connecting piece extension, with which, for example, the quantity of fresh water flowing in over time, the mixing ratio of hot to cold fresh water, and/or the temperature of the fresh water and the stream configuration may be influenced. In addition, the connecting piece extension may be used as a decorative element.

The connecting piece may also be placed on the wash basin. The connecting piece may also be implemented as flexible or in multiple parts, in such a way that the connecting piece extension which projects into the basin is pivotable around one or two axes or around a point. Furthermore, there is the possibility of designing the connecting piece in such a way that the position of the connecting piece extension is determined by the quantity and/or pressure of the fresh water flowing in.

In certain cases, particularly for washing purposes in kitchens or laboratories or even for washing hair in bathrooms or hair salons, it is desirable to connect the connecting piece to the fresh water supply via a flexible line. The connecting piece and hose may then be pulled from a rest position, in which the connecting piece does not project into the basin or only the connecting piece extension projects, into an active position, in which the connecting piece is manually guided.

In order to increase the operating comfort, the washing device suggested may also be implemented so that not only fresh water, but also additives, generally in liquid form, such as detergent and/or soap solutions and/or a disinfectant used after washing and possibly hot air for drying the object or body part washed, may be supplied through the connecting piece already cited or possibly through one or more additional connecting pieces.

The supply of the fresh water is not controlled directly through manual actuation of an actuating element such as a lever or a control knob, but is remote-controlled with the aid of a sensor device, which is connected to the shut-off member via a pneumatic or electrical line arrangement. In this case, however, the quantity of water supplied over time, the mixing ratio of hot to cold fresh water, and the stream configuration may be influenced by the user, if a suitable sensor device is positioned. Typical washing devices having typical armature parts like faucets, particularly in public areas, are already often currently equipped with sensors which react to pressure and/or contact, which may be actuated by hand or foot pressure. Sensors which are actuated through foot pressure are preferable for hygienic reasons, since renewed contamination of the just washed hands by touching the supply device is dispensed with. Furthermore, there are currently systems which operate using infrared and/or radar. However, these systems only allow the supply to be switched on and off.

Not only for hygienic reasons, but also for ecological reasons, i.e., for reduction of the fresh water consumed and the energy consumed, it is especially advantageous to control the supply of the fresh water, and preferably its quantity and temperature, remotely with the aid of sensors acting without contact, which only bring the shut-off member into an open setting when an object or body part to be cleaned is located in the basin. Such sensors largely prevent improper use by a user and allow thrifty fresh water consumption.

As an example of this remote control, a sequence of hand washing and drying in a combined washing/drying basin, selected for exemplary purposes, is described:

The dry hands are held in the middle of the wash basin. The two sensors on the left and right, which are positioned symmetrically in relation to the fresh water outlet and are now practically identically excited, turn on the fresh water supply (cold and hot water). The hands are wetted.

If the right hand, which sets the temperature, is moved to the right, toward the right sensor, which is now excited more, the water becomes colder until both hands are moved together into the middle.

If the left hand, which sets the temperature, is moved to the left, toward the left sensor, which is now excited more, the water becomes warmer until both hands are moved together into the middle.

Any time both wet hands are moved forward toward a third sensor positioned in the direct proximity of the fresh water outlet, a single addition of liquid soap to the fresh water is triggered. Using soap and fresh water of the temperature selected, the hands may now be washed.

Pulling back both hands out of the wash basin interrupts the fresh water supply and dipping the wet hands (left hand near the left sensor and right hand near the right sensor) back in turns on the hot air supply, which preferably flows out of the same outlet opening as the fresh water and soap did previously, into the wash basin, which now functions as a drying device.

If the left hand, which feels the hot air, is kept still and the right hand, which sets the temperature, is moved to the right toward the right sensor, which is now excited more, the hot air becomes colder until both hands are moved together into the middle.

If the right hand, which feels the hot air, is kept still and the left hand, which sets the temperature, is moved to the left toward the left sensor, which is now excited more, the hot air becomes warmer until both hands are moved together into the middle.

After the hands are moved together and dried, the hot air supply is interrupted as soon as the hands are removed from the washing/drying basin.

For the safety of the user, the maximum temperatures for water and air are preferably permanently set at a safe value of 55° C. and may not be exceeded in any case.

Among other things, the following embodiments or combinations of the sensors, which are well-known to all those skilled in the art, are especially suitable for controlling and/or regulating, i.e., for triggering and influencing, the supply of the fresh water and possibly the quantity and temperature of the fresh water with the aid of remote-controlled contactless sensors:

sensors for generating and detecting an electrical field;

sensors and/or cells which react to proximity (instead of pressure), distance sensors;

optical sensors such as light-sensitive resistors or photocells in connection with the passive effect of light through ambient light;

sensors in combination with resonance circuits which may be influenced, energy measurement, and image processing;

sensors as parts of barriers and/or reflection barriers, such as light barriers, radar barriers, ultrasound barriers, microwave barriers, and electrostatic or electrokinetic barriers, movement sensors, according to one of the following principles, for example: pyro, radar, high-frequency, sound, optical, photoresistor, photodiode, phototransistor.

The sensors of the sensor device may be positioned in and/or on the basin or in the surroundings of the washing device, for example, on or in the structure which supports the basin, on or in a building wall, a floor, or a room ceiling; if the washing device is endangered by vandals, it is suggested that the sensors be positioned so that the user has no access thereto. In addition, the sensors may be positioned in a connecting piece positioned on the basin, which also provides the supply of the medium. In connection with the present invention, the concept of "medium" includes all fluid media which may be used for cleaning and/or drying material, such as detergent, cold water, hot water, mixed water, disinfectant, gases such as nitrogen gas, or heated air. The concept of "material" includes all body parts or objects which may be impinged using the media for washing and/or drying.

As described above, the washing device suggested may be implemented in such a way that the supply of fresh water, i.e., its quantity flowing in over time and its temperature and/or the mixing ratio of hot water to cold water, may be influenced by the user. The quantity and/or temperature of the fresh water and/or of the medium may also be determined in other ways, for example, as follows:

The quantity of fresh water flowing in may be fixed or set by influencing suitable parameters; for example, the quantity may be regulated as a function of the pressure in the supply line. The temperature of the fresh water flowing in may be regulated or controlled and/or set and stored at a fixed value.

The influencing of the temperature may be performed as follows:

electronically and/or electromechanically with the aid of actuators, in that the temperature is preselected in the normal washing procedure (as described above) and is electronically stored by laying the right and/or left hand on the basin edge, so that the positioning of an object or body part in the basin is analyzed.

mechanically with the aid of a regulating screw;

electronically with the aid of a temperature sensor and a corresponding setpoint preset;

electromechanically with the aid of a bimetallic element and a bimetallic setpoint preset;

with the aid of the water supply via an instantaneous water heater or boiler.

Up to this point, only the supply of the medium to the basin and the supply device used for this purpose has been described in more detail. As was already briefly mentioned above, typical washing devices also have a drain armature, via which the dirty water may flow into the building sewer line and then into the sewer system.

It is mentioned here only for the sake of completeness that the drain armature may either allow continuous drainage of the dirty water or may have a typical device, using which the water may be prevented from flowing out of the basin, the arrangement of a non-closable overflow opening being necessary or at least extremely recommended in the latter case.

The drain armature is typically provided with a stench trap device, which is referred to as a siphon, having multiple angles. This stench trap device is implemented in such a way that the line between the basin and the sewer system is always completely filled with water in at least one cross-section, but in practice in a certain region. Through this water, a type of stopper is formed, which prevents the smells of the sewer system from flowing into the basin and thus into the room. If a basin is not used for a certain period of time, a part of the water which forms the stopper will evaporate, as a function of the ambient temperature and the ambient pressure, so that the stench trap is not maintained. In order to prevent this, the washing device suggested—as well as any other washing and/or drying device provided with an automatic supply for fresh water—may be provided with a protective device for maintaining the stench trap. This protective device has a sensor positioned in the region of the siphon, which reacts to a change of a state variable in a siphon, the water level or stench, for example, and causes a small quantity of fresh water to flow into the basin in the event of inadequacy of the stench trap, in order to produce the stench trap again. To maintain and/or reproduce the stench trap, supplying a small quantity of fresh water after a specific time interval or after a specific time interval from the last use of the washing device may also be provided.

BRIEF DESCRIPTION OF THE DRAWINGS

In the following, further details and advantages of the present invention are described in greater detail on the basis of exemplary embodiments and partially with reference to the drawing. All figures are schematic and not to scale, and corresponding constructive elements are provided with identical reference numbers in the different figures, even if they are designed differently in detail.

FIG. 7 shows variants of a connecting piece, placed on a wash basin, having integrated water outlet and sensors:

DETAILED DESCRIPTION OF THE PREFERRED EMBODIMENT

Figure 1:
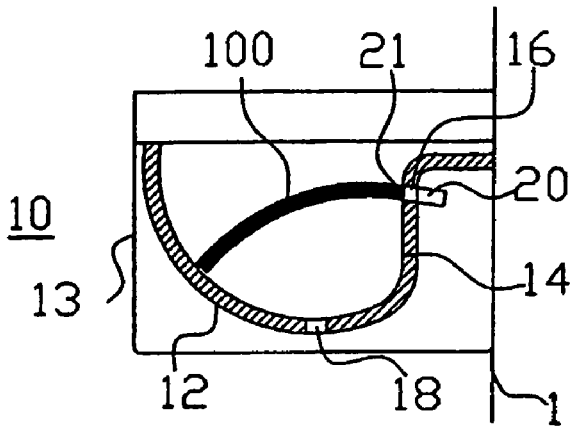
FIG. 1 shows a washing device according to the present invention implemented as a washstand, in a vertical section.

FIG. 1 shows a washing device 10, positioned on a building wall 1, in the form of a washstand, also identified with reference number 10. The washing device 10 includes a basin 12, which may optionally be positioned in a basin enclosure 13. The basin 12 is delimited by a basin wall 14, which has a first opening 16 in its upper region and a second opening 18 in its lowest region. A connecting piece 20, which is integrated into the basin wall 14 and which forms an essential part of the supply device (not shown further in FIG. 1), is attached in the first opening 16, which may also only be a breakout and/or a notch reentrant from the edge of the basin. The outlet cross-section 21 of the connecting piece 20 is positioned flush with the inner surface of the basin wall 14 or inside the basin wall. The fresh water flows out of the connecting piece 20 into the basin 12 in a preferably bubbling stream 100.

Figure 2:
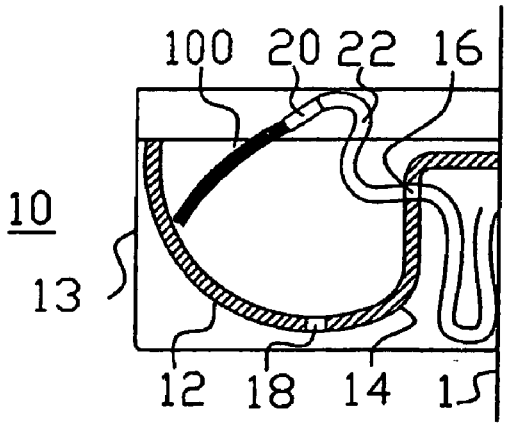
FIG. 2 shows the washstand shown in FIG. 1, but with a connecting piece which is connected to the supply line via a flexible adapter, in a vertical section.

FIG. 2 shows a washstand 10 similar to that in FIG. 1, with the single difference that the connecting piece 20 is connected to the fresh water supply line (not shown) via a flexible adapter and/or a hose 22. The connecting piece 20 and part of the hose 22 may be pulled out of a resting position, in which the connecting piece 20 is received in the basin wall 14, through the first opening 16 to the inside of the basin 12 in the position shown in FIG. 2.

Figure 3:
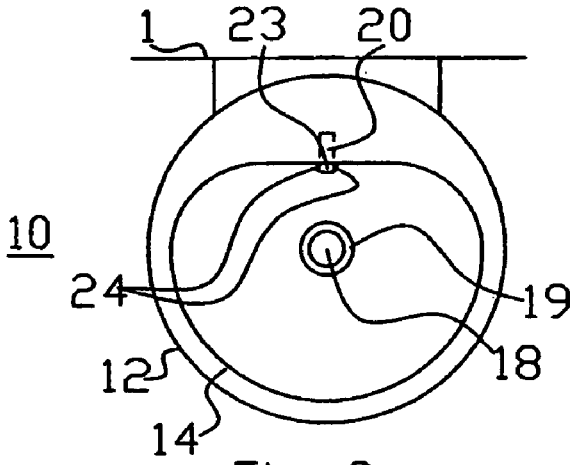
FIG. 3 shows a washing device according to the present invention implemented as a washstand, having a connecting piece extension, in a top view.

The washstand 10 illustrated in FIG. 3 is implemented essentially identically to the washstand of FIG. 1, but its connecting piece 20, which is integrated into the basin wall 14, has a connecting piece extension 23, projecting slightly over the basin wall 14 into the inside of the basin 12, which contains a spray nozzle. A drain armature 19, attached in the second opening 18, is positioned centrally in the basin 12. Such an arrangement is suggested, for example, if the washstand 10 is also to be used for washing hair, or if the washstand is to be used for washing bulky objects or for filling large vessels. Actuating elements 24 are positioned on the connecting piece extension 23, using which the supply of fresh water may be started and possibly its quantity over time and temperature may be controlled.

Figure 4:
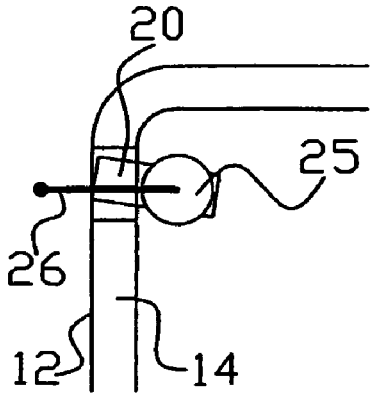
FIG. 4 shows a washing device according to the present invention implemented as a washstand having a pivotable connecting piece, in a vertical partial section.

FIG. 4 shows a connecting piece 20, which is pivotably mounted using a ball and socket joint 25, a handle 26, which projects into the inside of the basin 12, being provided for adjusting the connecting piece 20.

Up to this point, only the arrangement and use of the washing device 10 for washing and/or cleaning an object using fresh water has been described in detail, the duration of the flow, the quantity, and/or the temperature of the fresh water flowing in able to be influenced. However, the washing device may also be implemented so that it allows the execution of additional functions. In particular, additives 102, i.e., generally further fluids, may be added in this way, for example, cleaning products such as soap, disinfectant, or hot air. The addition of additives may be initiated automatically or remote-controlled manually. In this case it is possible to supply the additives 102 through the same connecting piece 20 or at least through the same opening of the basin or even through one or more further openings of the basin. It is especially advantageous if the basin may also be supplied with hot air for drying the objects cleaned or the washing device 10 itself.

The supply of the various fluids may, for example, be performed in the following sequence:

fresh water for wetting the hands
soap
fresh water for washing off the soap
possibly disinfectant
hot air for drying the hands.

Such arrangements are particularly suitable for laboratories and hospitals.

Figure 5:
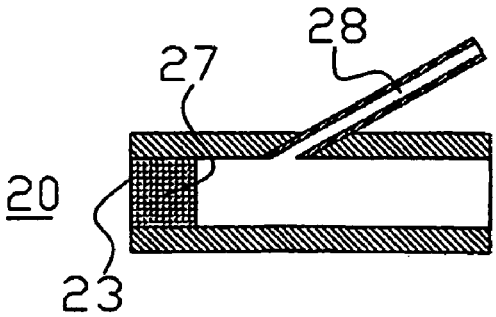
FIG. 5 shows a connecting piece having a mouth part designed as a spray nozzle and an additive connection, in a section which contains the connecting piece lengthwise axis.
Figure 6:
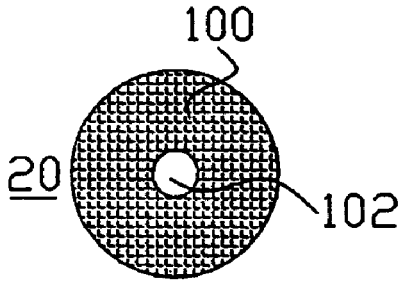
FIG. 6 shows a connecting piece having an additive connection, in order to introduce an additive centrally into the outlet cross-section, in a view from the inside of the basin.

A connecting piece 20, which contains a spray nozzle 27 in the region of its outlet cross-section 21, is illustrated in FIG. 5. Furthermore, this connecting piece 20 has an auxiliary connecting piece, which forms an additive connection 28, through which a suitable additive 102 may be supplied. FIG. 6 shows a further connecting piece 20, using which an additive 102 may be supplied centrally and/or within the stream 100 of the fresh water.

Figure 7B:
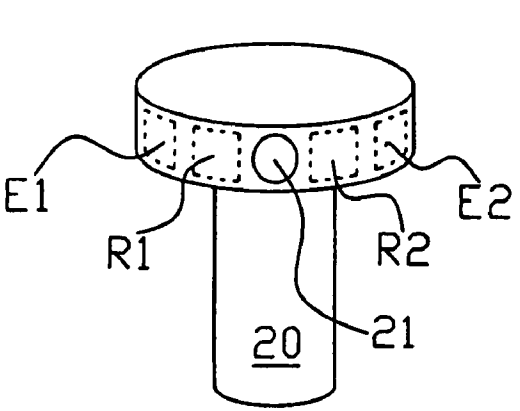
FIG. 7B illustrating a first armature having integrated sensors for generating an electrical field.
Figure 7C:
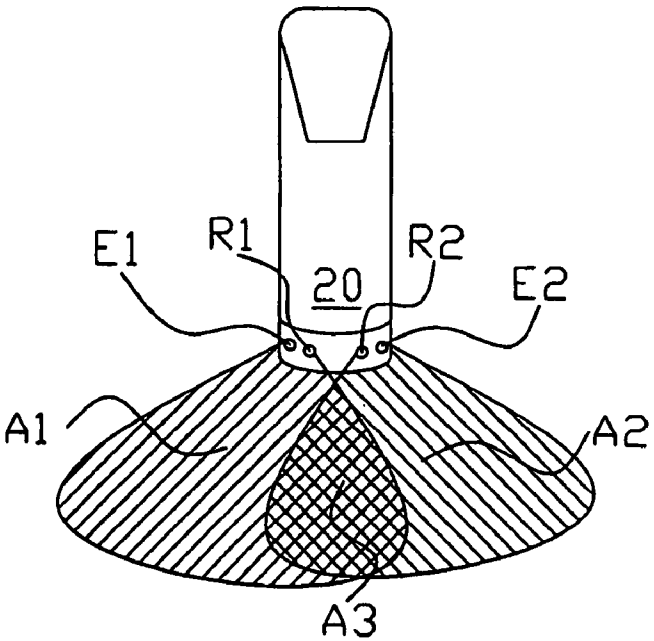
FIG. 7C illustrating a further armature having integrated sensors for generating an optical field.
Figure 7A:
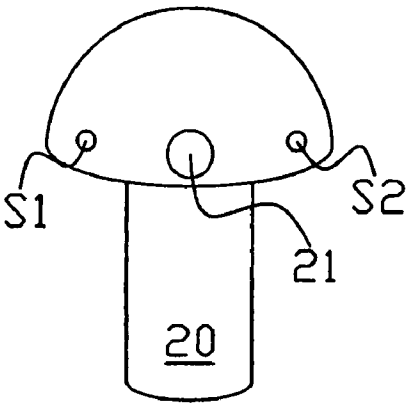
FIG. 7A illustrating an armature having two sensors for the positioning (optical, ultrasound, pyro, etc.)

FIG. 7 shows variants of a connecting piece 20, placed on a wash basin 10, having integrated water outlet and sensors. FIG. 7A shows an armature having two sensors S1, S2 (optical, ultrasound, pyro, etc.) for determining the presence and the position of the hands in the wash basin. FIG. 7B shows a first armature having especially preferred, integrated sensors for generating an optical field: four cells are positioned on the connecting piece 20, specifically two transmitters E1, E2 and two receivers R1, R2 (cf. also FIG. 9, in which these cells are positioned in the basin wall 14). For this capacitive solution, these cells essentially comprise four plates. FIG. 7C shows a further armature having integrated sensors for generating an electrical field, the four cells E1 and R1 and E2 and R2, respectively, being positioned in a collar at the foot of the connecting piece and generating and/or monitoring the fields A1, A2 and/or their overlap region A3.

Alternatively to what is shown in FIG. 7, the intake connecting piece 20 may also be positioned in a wall 1, on which the wash basin 10 is positioned, over the basin 12. The cells E1, R1 and/or E2, R2 (cf. also FIG. 9) for generating an electrical or optical field are then preferably also positioned to the left and right of the intake connecting piece 20 in the wall 1 over the basin 12. The sensor device 50 is preferably combined with the connecting piece 20 into a module 60 (cf. also FIG. 13).

Figure 8:
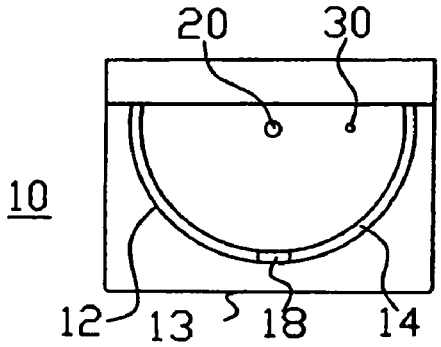
FIG. 8 shows a washing device according to the present invention implemented as a washstand, having an additional connecting piece for an additive, in a front view.

A variant for the additive supply is illustrated in FIG. 8. In this case, the connecting piece 20 is used for supplying the fresh water, while an auxiliary connecting piece 30 is provided for additive supply. The greater constructive outlay is disadvantageous in this case, but it is advantageous that in cases in which the fresh water is also to be consumed, there are no residues of additives 102 in the connecting piece 20.

In the following, the arrangement and mode of operation of the sensor device 50 are described, using which the inflow and/or the temperature of the fresh water and possibly of the additive(s) to the basin may be controlled.

It is to be noted here that the sensor devices described in the following may also be used in typical washing devices having connecting pieces which are not integrated into the basin wall, in which the fresh water is supplied in a typical way via a connecting piece to a faucet, this faucet not having an actuating element for displacing the shut-off member, i.e., no control knob or lever, however, since this member may be actuated by remote control with the aid of the sensor device. However, the combination of the connecting piece integrated into the basin wall with the remote-controlled actuation of the shut-off member is especially advantageous, as described above.

A further and—in relation to the modes of operation already described—very simple variant of the design and operation of the basin is as follows: an object to be cleaned, which may even be a body part, is held in a basin. A sensor device of any type senses the presence of this object and/or body part and acts on a shut-off member in such a way that it is moved from its closed position into an open position, so that fresh water flows into the inside of the basin through a connecting piece integrated into the basin.

The supply of fresh water may be interrupted in various ways, for example:

upon removal of the object from the basin; or
a short period of time, for example one second, after removal of the object from the basin; or
after a specific, preselectable period of time, during which fresh water flows in; or
according to a combination of the three criteria just cited.

Figure 9:
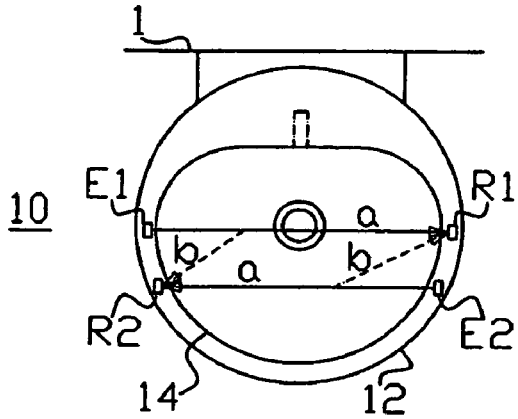
FIG. 9 shows the washstand illustrated in FIG. 1, having a first sensor device, in a top view.
Figure 13:
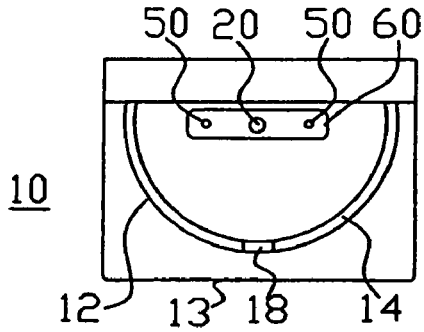
FIG. 13 shows the washstand illustrated in FIG. 1, having a fifth sensor device, in a front view.

In the variant illustrated in FIG. 9, the sensor device, which is only indicated with 50 in FIG. 13, has four cells positioned on the basin 12 and/or in the basin wall 14, specifically two transmitters E1, E2 and two receivers R1, R2. For a capacitive solution, these cells essentially comprise four plates which form an electrical field, for an optical solution they comprise two optical transmitters and two optical receivers.

The number of cells used is not restricted, in principle, one to n cells and/or one to n sensors may be provided. The cells react as barrier cells and as reflection cells. A barrier reaction generally occurs if an object reaches the inside of basin 12. A reflection reaction occurs if an object reaches a very specific region of the basin 12, for example, if a washcloth is hung over the edge of the basin 12.

Various sequences may be executed using this arrangement:

If an object is held in the middle of the basin 12, cells E1, R1 and E2, R2 act as barrier cells, which is illustrated by the arrows (a), and the supply of fresh water is initiated. After removal of the object, the supply of fresh water is interrupted immediately or after a certain period of time and/or dwell time; if only an object such as a washcloth is hung over the edge of the basin, a barrier reaction occurs and the inflow of fresh water would begin; this inflow would be prevented, however, by the reflection reaction occurring simultaneously, which is illustrated by the arrows (b).

if an object is held in the basin 12, a barrier reaction occurs and the supply of fresh water is started. Subsequently, the quantity of fresh water flowing in over time and/or the temperature of the water flowing in may be controlled by causing a reflection reaction.

Figure 10:
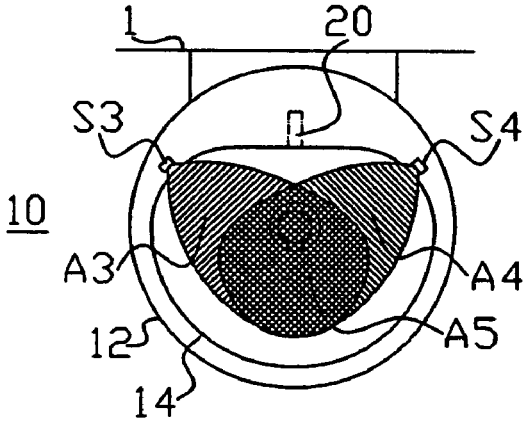
FIG. 10 shows the washstand illustrated in FIG. 1, having a second sensor device, in a top view.

In the variant illustrated in FIG. 10, two sensor devices S3, S4, ultrasound sensors, for example, are positioned.

Each of the sensor devices S3, S4 monitors its environment in a region A3 or A4, respectively, of a teardrop-shaped cloud. These regions A3, A4 form an overlap region A5 in the middle of the basin 12.

Using this arrangement, the following possibilities are obtained:

If an object is held in the middle of the basin 12 and/or in the overlap region A5, it is registered by both sensor devices S3, S4 and the supply of fresh water is initiated. After the object is removed, the supply of fresh water is interrupted immediately or after a certain period of time and/or dwell time.

If a washcloth is laid over the sensors S3, S4, the inflow of fresh water is prevented.

If an object is registered by both sensors S3, S4, the supply of fresh water is initiated. If one of the sensors S3, S4 subsequently detects a proximity, it exercises a control function, for example, the quantity or the temperature of the fresh water flowing in may be controlled.

In a further variant (not shown), the supply of water is initiated by touching a cell and/or a marked point. There are preferably two cells and/or marked points, e.g., red and blue. By pressing the red and/or blue cell for a longer time, the temperature of the fresh water flowing in is caused to rise and/or fall. By actuating both cells and/or marked points for a longer time, the quantity of fresh water flowing in is influenced. The supply of fresh water is interrupted by briefly actuating one cell.

Figure 11:
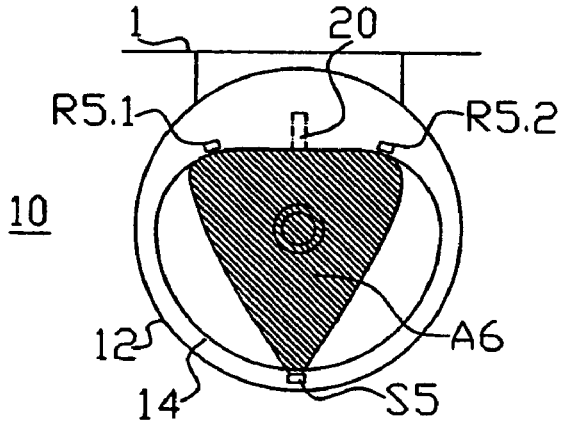
FIG. 11 shows the washstand illustrated in FIG. 1, having a third sensor device, in a top view.

The variant illustrated in FIG. 11 provides a sensor device in which a transmitter E5 and two receivers R5.1, R5.2 are positioned on the edge of the basin 12 and connected in such a way that the quantity and/or the temperature of the fresh water flowing in is influenced in a region A6 through certain hand movements, for example, toward the edge of the basin 12 or down into the bottom of the basin 12.

Figure 12:
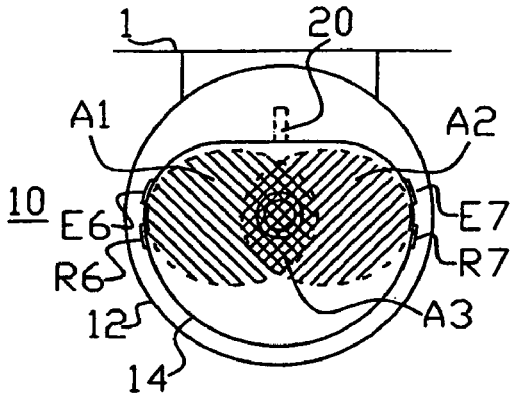
FIG. 12 shows the washstand illustrated in FIG. 1, having a fourth sensor device for generating an electrical field, in a top view.

Two sensor units are used for a further variant shown in FIG. 12. Sensor devices operating according to any arbitrary technology may be used, for example, acoustic, optical, or capacitive. Sensor units E6, R6 and E7, R7, which form capacitive electrical fields A1, A2, and which may be integrated into the basin wall 14, for example, are especially suitable. For this purpose, two electrical fields A1, A2 are generated, having an overlap region A3. If an object is held in the middle of the basin 12 and/or in the overlap region A3, it causes a reaction of both receiver cells R6, R7, and the supply of fresh water is initiated. If one of the electrical fields is then influenced more strongly, the quantity of the fresh water and its temperature may be varied. This is also possible using an arrangement in which the sensor device operates according to the reflection method and transmitters E6 and E7 and receivers R6 and R7, respectively, each lie on the same side of the basin 12. In combination with a wash basin 10 and a sensor device 50 as shown in FIG. 12, armatures of typical design may also be used. These are then actuated via the sensors and actuating elements, so that even with such conventional armatures, the fresh water temperature may be set by the user without contact.

The washing device 10 illustrated in FIG. 12 thus includes a device for controlling the supply of a medium through a supply unit. The basin 12 may also be referred to as an impingement device, because the hands are impinged with water. The supply unit comprises at least one shut-off member and each shut-off member may be brought into a closed position and/or at least one open position using an actuating element. This device 2 for controlling the supply of a medium includes a sensor device 50 for contactless determination of the presence of material to be impinged using this medium and/or of hands. This sensor device 50 is additionally implemented for contactless determination of the relative position of the hands in relation to the basin and/or the impingement device and for outputting signals, which act on the actuating elements in such a way that they bring the shut-off members into a setting corresponding to the presence and the position of the hands.

Another variant, which may be combined with the variants above, provides using a large quantity of fresh water, preferably hot and having a cleaner or disinfectant, at specific time intervals and/or after a specific number of uses of the washing device, in order to clean the basin.

As shown in FIG. 13, the sensor device 50 may be positioned together with the connecting piece 20 in a module 60, which results in simplification and/or allows the replacement of no longer functional parts and results in visually pleasing effects.

Figure 14:
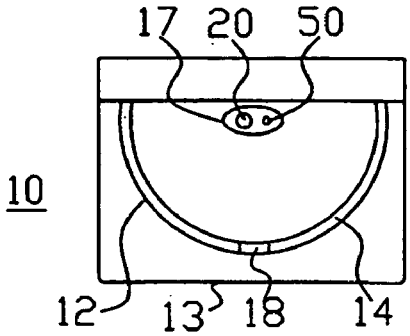
FIG. 14 shows a washstand having an overflow opening, in which the connecting piece and the sensor device are positioned.

The connecting piece 20 or the sensor device 50 may be positioned in an overflow opening 17 of the basin wall. An especially advantageous arrangement is shown in FIG. 14, according to which both the connecting piece 20 and the sensor device 50 are positioned in the overflow opening 17.

Figure 15:
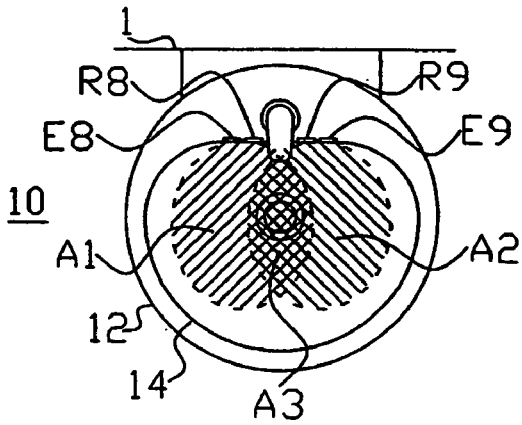
FIG. 15 shows the washstand illustrated in FIG. 12 having an intake connecting piece and a sixth sensor device for generating an electrical field, in a top view.

As shown in FIG. 15, the cells E8 and/or R8 and E9 and/or R9 may be positioned in the rear edge of the basin and may generate and/or monitor the electrical fields A1, A2 and/or their overlap region A3.

The various modes of operation which are possible using the washing and/or drying device suggested may also be visualized.

The following possibilities are cited as examples for visualization:

Illuminants and/or display means in the basin or in the environment of the basin or on a monitoring station; the display may be produced through variation of the intensity or the number of the illuminants;

Display for displaying various variables, analog and/or digital;

Display may be implemented as a touch screen and is thus usable as a sensor device;

Acoustic displays, i.e., signal tones and/or speech;

Parameterization of various washing and cleaning programs via remote control and building system control;

Display upon reaching a maximum temperature of the fresh water and/or the hot air.

As mentioned above, the basins 12 not only have supply devices, but also drain armatures 19, which are mounted in a second opening 18 of the basin wall 14. Basins which are not used simply as flow-through basins, but in which a certain quantity of fresh water—possibly having an additive—is to be accumulated, have drain armatures 19 having a closing member. The closing member may be actuated manually or, preferably, via remote control in this case, in an analogous way to the shut-off member; basins 12 having closing members typically have an overflow opening 17 in the upper basin region, in order to avoid overflow of the basin. Such an overflow opening may possibly be dispensed with, if there is a sensor system which brings the closing member into its open position and/or interrupts the water supply as soon as the water level in the basin has reached a specific level.

Figure 16:
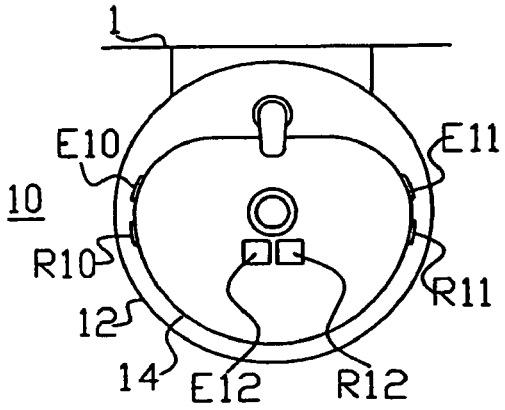
FIG. 16 shows a washstand having an intake connecting piece and a seventh sensor device for generating an electrical field, in a top view.

FIG. 16 shows a washstand having an intake connecting piece 20 incorporated into the surface of the basin. The sensor device 50 for generating an electrical field includes the cells E10 and/or R10 and E11 and/or R11, which are positioned on the side edge of the basin 12, corresponding to the cells in FIG. 12. In addition, the sensor device comprises a transmitter cell E12 and a receiver cell R12, which are positioned next to one another—to generate a third electrical field—on the floor of the basin near the opening 18 for receiving the drain armature 19. Using this arrangement, a field-amplifying or field-diminishing object (e.g., hands) may be detected three-dimensionally, which allows additional expansion of the control possibilities in the framework of the present invention. In addition, the water surface in the basin may be detected and the supply of fresh water may be stopped and/or the closing member in the drain may be opened if necessary, i.e., if a specific filling height is exceeded. An overflow opening 17 is then no longer necessary. This filling height monitoring may also be used in a basin having a typical armature, which is known per se. Therefore, an overflow fitting, which is known to be subject to contamination, may be dispensed with. Overflow of the basin is then successfully prevented by the sensors even if the quantity of fresh water supplied may not be drained off because, for example, a wash cloth covers the drain opening.

Accordingly, the washstand of the present invention controls or regulates the supply of medium, e.g. a cleaning agent, cold water, hot water, a disinfectant, a gas, and/or heated air, through a supply unit for the medium. The supply unit includes the at least one shut-off member and each shut-off member is able to be brought into a closed position and/or at least one open position using an actuating element. The washstand includes the sensor device 50 for contact-less determination of the presence of parts of the body to be impinged by the medium, and for contact-less determination of the relative position of the parts of the body in relation to a basin of the washstand for outputting signals which act on the actuating element in such away that they bring the shut-off member into a setting corresponding to the presence and the position of the parts of the body. The sensor device includes the at least two sensors, e.g. E10, R10 and E11, R11, positioned to the left and right of the fresh water outlet 21, preferably symmetrically in relation to this fresh water outlet 21. The basin 12 has a basin wall 14 and the device for controlling the supply of medium can be positioned in the basin wall 14. The controlling device may alternatively be in a module 60 that is separated from the basin wall. The connecting piece 20 and the sensor device 50 may be positioned in an overflow opening 17 of the basin wall 14. The basin may have a drain armature 19 at a drain opening 18 of the basin, with a closing member connected to a sensor, which may be actuated by remote control via the sensor. The drain armature 19 includes a siphon for creating a stench or odor trap that is downstream from the basin 10, attached in the drain opening 18, a sensor being positioned in the region of the siphon which reacts to a falling away of the stench trap. This sensor is connected to the shut-off member to temporarily bring it out of its closed position and into an open position in the event the stench trap falls away, to supply a quantity of fresh water which recreates the stench trap.

A corresponding overflow protection may also be implemented if distance sensors (e.g., optical, acoustic, radar, capacitive, etc.) are positioned on an arbitrary point, preferably on the armature, on the basin, or on a wall 1 which supports the basin. Corresponding reflection or pass-through barriers may also be attached in the basin 12. A further embodiment variation for an overflow protection comprises a vessel (not shown), communicating with the basin 12, which is positioned behind the washing device 10, for example, and to which a level sensor is connected. All of these embodiments of an overflow protection share the feature that upon reaching a predetermined water level in the wash basin, the fresh water supply is automatically interrupted. In addition, the supply of all other media may also be interrupted.

Figure 17:
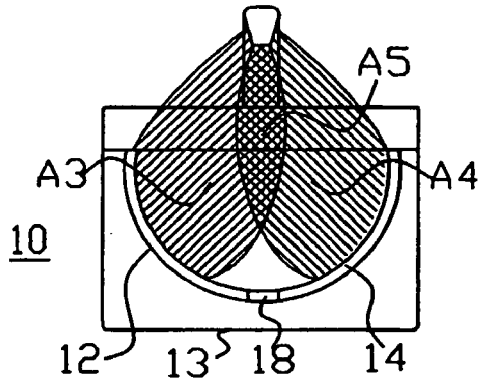
FIG. 17 shows a washstand having a variant to the connecting piece illustrated in FIG. 7C, in a front view.

FIG. 17 shows a washstand 10 having a connecting piece in a variation to that illustrated in FIG. 7C, in a front view. The two pairs of cells E13 and/or R13 and E14 and/or R14 are attached at the highest point of the bottom of the curved connecting piece 20 and generate and/or monitor the two fields A3, A4 and the overlap region A5. The filling height in the basin 12 may also be monitored using this arrangement.

Figure 18:
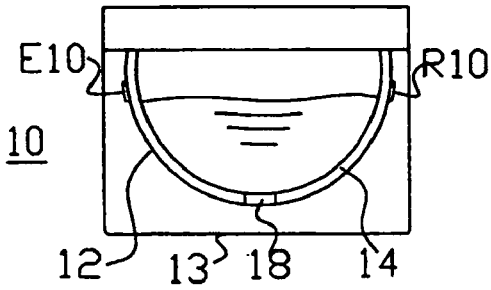
FIG. 18 shows a simplified embodiment of a sensor device as shown in FIG. 16, in a front view.

FIG. 18 shows an embodiment of a sensor arrangement, simplified in relation to that illustrated in FIG. 16, in a front view. The two pairs of cells E10 and/or R10 (shown) and E11 and/or R11 (not shown) are attached at the highest point of the basin wall 14, determined by a maximum filling state, and generate and/or monitor two electrical fields. If the water rises to the height of the receiver cells E10 and/or E11, the electrical fields are thus strongly changed. This change is used to trigger stopping of the fresh water supply and/or to open the drain armature. Therefore, the filling height may also be monitored using this arrangement and an overflow opening 17 may be dispensed with. This embodiment is suitable (as described) for changing the fresh water temperature by the user. If, however, only the filling state is to be monitored, providing only one transmitter cell E10 and one receiver cell R10 (shown) suffices for this purpose.

The drain armature includes a siphon, which forms a stench trap device between the basin and the sewer system, in that at least one cross-section of the siphon always contains water, through which a type of water stopper is formed. If a washing device is not used for a long period of time, a part of the water in the siphon may evaporate, so that the stench trap is no longer present. In order to prevent this, a siphon sensor may be positioned in the region of the siphon, which is coupled to the shut-off member, and briefly brings the shut-off member into its open setting if the stench trap falls away due to a water level in the siphon which is too low, so that a small quantity of fresh water flows in, which is sufficient to ensure the stench trap again. Alternatively, a small quantity of fresh water may be added to maintain and/or reproduce the stench trap using a time-delay element, as described above.

In a further embodiment of the present invention, the stench trap is implemented by a time-controlled (for example, using a periodic interval) controller.

Finally, it is also to be noted that the energy for the washing device suggested may be supplied from the mains, using mains voltage or low voltage, or from a battery or an alternative source. The electronics may be implemented so they are capable of bus or building system control, in particular for the parameterization of washing and cleaning programs and for statistical analyses.

What is claimed is:

1. A washstand comprising:

a basin;

a supply unit for supplying a medium to the basin for washing parts of the body, the supply unit including at least one shut-off member for regulating a supply of the medium;

an actuating element connected to the shut-off member for bringing the shut-off member into a closed position for stopping the supply of the medium, and into a plurality of different flow regulating open positions for supplying different quantities of the medium;

a controlling device connected to the actuating element for controlling the supply of the medium from the supply unit, the controlling device comprising a sensor device for contact-less determination of the presence of the parts of the body to be impinged upon by the medium at the basin, the sensor device including at least two sensor cells for generating an electrical field that changes as a function of the presence of the parts of the body with respect to the basin, and relative positions of the parts of the body with respect to the basin, the controlling device outputting signals which act on the actuating element to bring the shut-off member into different ones of the open positions which correspond to the presence and the relative positions of the parts of the body with respect to the basin.

2. The washstand according to claim 1, in which the sensor cells are positioned in at least two geometrically different planes and comprise two transmitters and two receivers defining first and second electrical fields, the sensor device including at least one additional transmitter and at least one additional receiver for defining a third electrical field, the third electrical field effecting a three-dimensional detection of a field-amplifying or field-diminishing object, the object comprising at least one of the parts of the body and a water surface in the basin, the third electrical filed being at an angle to the first and second electrical fields.

3. The washstand according to claim 1, wherein the supply unit includes a fresh water outlet, the sensor cells being positioned respectively to the left and right of the fresh water outlet.

4. The washstand according to claim 1, wherein the medium is selected from the group consisting of: a cleaning agent; cold water; hot water; a disinfectant; a gas; and heated air.

5. The washstand according to claim 1, wherein the basin has a basin wall, the controlling device being positioned in the basin wall.

6. The washstand according to claim 1, wherein the supply unit includes a fresh water outlet, the controlling device being positioned separately from a wall of the basin.

7. The washstand according to claim 6, wherein the outlet is formed from the material of the basin wall and is shaped onto the basin.

8. The washstand according to claim 6, wherein the outlet is formed by a pipe insert positioned in a first opening of the basin and has an outlet cross-section in the basin which is positioned substantially flush with an inner surface of the basin wall.

9. The washstand according to claim 6, wherein the outlet and at least part of the sensor device are combined into a module.

10. The washstand according to claim 6, wherein the outlet and the sensor device are positioned in an overflow opening in the basin wall.

11. The washstand according to claim 1, including a drain armature having a closing member that is connected to a sensor and that is actuated by remote control by said sensor, said armature being attached in an opening of a wall of the basin.

12. The washstand according to claim 1, wherein the medium is water and including a drain armature having a siphon for receiving some water to create an odor trap downstream of the basin, the drain armature being attached in an opening of a wall of the basin, a sensor positioned near the siphon, the sensor reacting to a falling away of the water in the siphon and thus detecting losing of the odor trap, and the sensor being connected to the shut-off member in order to bring the shut-off member temporarily out of the closed position and into one of the open positions when the water in the siphon falls away, for supplying some water to the siphon to recreate the odor trap.

13. A method of contact-less controlling of a supply of a medium through a supply unit for a washstand for washing parts of the body, the supply unit including at least one shut-off member and an actuating element, each shut-off member having a closed position and a plurality of flow regulating open positions using said actuating element, the washstand including a sensor device for contact-less determination of the presence of the parts of the body to be impinged upon using the medium, wherein this sensor device includes at least two sensor cells designed to act as transmitters or receivers for generating at least one electrical field and also of detecting a change in the at least one electrical field as a function of the parts of the body that are in the electrical field; the method comprising:

using the sensor device for detecting a presence of the parts of the body in the at least one electrical field and for registering a relative position of the parts of the body in relation to the washstand;

the sensor device outputting signals that are a function of the presence and relative position of the parts of the body; and using the signals to act on the actuating elements to bring the shut-off member into one of the open positions corresponding to the presence and the position of the parts of the body to be impinged by the medium.

14. The method according to claim 13, wherein, when the medium is fresh water, the sensor device is used for setting a temperature of the fresh water, and when the medium is air, the sensor device is used for setting a temperature of the air, for washing or for drying the parts of the body.

* * * * *